US008786501B2

(12) United States Patent
Yanagi et al.

(10) Patent No.: US 8,786,501 B2
(45) Date of Patent: Jul. 22, 2014

(54) MEMORY CARD

(75) Inventors: Masahiro Yanagi, Tokyo (JP); Shigemi Kurashima, Tokyo (JP); Hideaki Yoda, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 256 days.

(21) Appl. No.: 13/476,307

(22) Filed: May 21, 2012

(65) Prior Publication Data

US 2012/0313828 A1 Dec. 13, 2012

(30) Foreign Application Priority Data

Jun. 13, 2011 (JP) ..... 2011-131666

(51) Int. Cl.

| | |
|---|---|
| ***H01Q 1/24*** | (2006.01) |
| ***H01Q 1/22*** | (2006.01) |
| ***H01Q 1/48*** | (2006.01) |
| ***H01Q 9/42*** | (2006.01) |

(52) U.S. Cl.

CPC ..... *H01Q 1/2275* (2013.01); *H01Q 1/48* (2013.01); *H01Q 9/42* (2013.01)

USPC ..... 343/702; 343/700 MS

(58) Field of Classification Search

USPC ..... 343/702, 700 MS

See application file for complete search history.

(56) References Cited

U.S. PATENT DOCUMENTS

| | | | | |
|---|---|---|---|---|
| 7,511,668 | B2 * | 3/2009 | Hirabayashi | 343/700 MS |
| 7,529,098 | B2 * | 5/2009 | Aizawa | 361/737 |
| 2005/0224589 | A1 * | 10/2005 | Park et al. | 235/492 |
| 2009/0051606 | A1 | 2/2009 | Ochi et al. | |
| 2011/0009078 | A1 | 1/2011 | Kawamura | |
| 2011/0128193 | A1 * | 6/2011 | Arimura et al. | 343/702 |
| 2011/0182037 | A1 * | 7/2011 | Katsumura | 361/728 |
| 2012/0014076 | A1 * | 1/2012 | Abe et al. | 361/752 |

FOREIGN PATENT DOCUMENTS

| | | |
|---|---|---|
| JP | 2001-266098 | 9/2001 |
| JP | 2006-018624 | 1/2006 |
| JP | 2007-299338 | 11/2007 |
| JP | 2008-083868 | 4/2008 |
| JP | 2011-022640 | 2/2011 |
| WO | WO2007/125948 | 11/2007 |
| WO | WO2008/038756 | 4/2008 |

* cited by examiner

*Primary Examiner* — Hoang V Nguyen
(74) *Attorney, Agent, or Firm* — IPUSA, PLLC

(57) ABSTRACT

A disclosed memory card having a built-in antenna and being connected to an electronic apparatus includes a circuit board configured to be covered by a case, an antenna element formed on one surface of the circuit board or on one surface of a board mounted on the circuit board, and a ground element formed on another surface of the circuit board or on another surface of the board mounted on the circuit board, wherein a part or all of the antenna element and a part or all of the ground element are formed to protrude outside the electronic apparatus when the memory card is connected to the electronic apparatus.

16 Claims, 19 Drawing Sheets

MEMORY CARD

CROSS-REFERENCE TO RELATED APPLICATIONS

This patent application is based upon and claims the benefit of priority of Japanese Patent Application No. 2011-131666 filed on Jun. 13, 2011, the entire contents of which are incorporated herein by reference.

BACKGROUND OF THE INVENTION

1. Field of the Invention

The present invention generally relates to a memory card.

2. Description of the Related Art

An image, a video or the like is captured by a camera or the like, and the captured image, the video or the like is stored in a recording medium installed in the camera or the like. However, because the recording medium is ordinarily installed inside the camera, there is an upper limit in a memory capacity. Therefore, an image or a video having a predetermined period of time or longer may not be stored in the camera.

Instead of recording a captured image or video in a recording medium installed in a camera, information may be wirelessly transmitted to and stored in a large capacity recording medium provided outside the camera. In this case, a large amount of images and videos can be stored regardless of the capacity of the recording medium installed in the camera.

In order to transfer information from the camera to the large capacity recording medium, an antenna for wireless communication may be installed inside the camera. An antenna for wireless communication is disclosed in, for example, Japanese Laid-open Patent Publication No. 2001-266098, Japanese Laid-open Patent Publication No. 2006-18624, Japanese Laid-open Patent Publication No. 2007-299338, Japanese Laid-open Patent Publication No. 2008-83868, Japanese Laid-open Patent Publication No. 2011-22640, International Publication Pamphlet No. 2007/125948, and International Publication Pamphlet No. 2008/038756.

SUMMARY OF THE INVENTION

When a memory card is installed in a camera or the like, an antenna does not ordinarily protrude from the body of the camera or the like. For example, a camera body may be covered by a metallic case, and a memory card may be surrounded by the metallic case and further by a battery and an electronic circuit board including a conductive portion. Therefore, when the memory card having the antenna is installed in the camera, it may be difficult to send information by wireless communication from the inside of the camera body to the outside of the camera body. In this case, the information may not be accurately transmitted or a spacial area where the information is transmitted may be limited.

Accordingly, embodiments of the present invention may provide a novel and useful memory card, the memory card being designed to be loaded into an electronic apparatus including an information technology device such as a camera, the memory card having a built-in antenna with an excellent wireless communication performance solving one or more of the problems discussed above. More specifically, the embodiments of the present invention may provide a high communication performance even if the antenna device, the circuit board and the memory card are installed inside cases of information technology devices.

Another aspect of the present invention may be to provide a memory card having a built-in antenna, being connected to an electronic apparatus, and including a circuit board configured to be covered by a case, an antenna element formed on one surface of the circuit board or on one surface of a board mounted on the circuit board, and a ground element formed on another surface of the circuit board or on another surface of the board mounted on the circuit board, wherein a part or all of the antenna element and a part or all of the ground element are formed to protrude outside the electronic apparatus when the memory card is connected to the electronic apparatus.

Additional objects and advantages of the embodiments are set forth in part in the description which follows, and in part will become obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

A description is given below, with reference to the FIG. 1 through FIG. 21 of the embodiments. Where the same reference symbols are attached to the same parts, repeated description of the parts is omitted.

First Embodiment (Antenna Device and Circuit Board)

Figure 1:
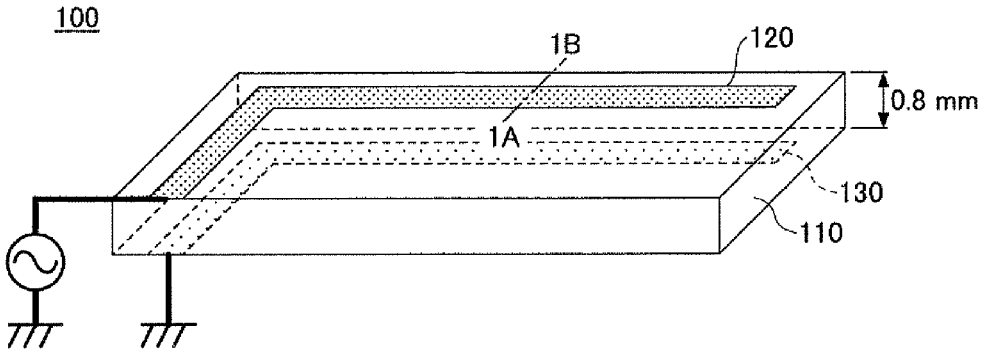
FIG. 1 illustrates a structure of an antenna device of a first embodiment.

The antenna device and the circuit board of the first embodiment are described. Referring to FIG. 1, the antenna device 100 of the first embodiment has an antenna element 120 on one side of a printed-wiring board 110 and a ground element 130 on the other side of the printed-wiring board 110.

The antenna element 120 and the ground element 130 are made of a metallic material such as copper. The antenna element 120 and the ground element 130 are symmetrically arranged relative to the printed-wiring board 110. The ground element 130 of the antenna device 100 is grounded, and a high-frequency voltage of, for example, 2.4 GHz to 2.5 GHz is applied to the antenna element 120.

The antenna device of the first embodiment may be used for communications in a frequency range of 2.4 GHz to 2.5 GHz, in wireless LAN, or in Bluetooth (BT) ("Bluetooth" is a registered trademark). In the antenna device of the first embodiment, inductors having predetermined inductances may be connected to the antenna element 120 and the ground element 130, respectively, in order to adjust a resonance frequency.

Figure 2:
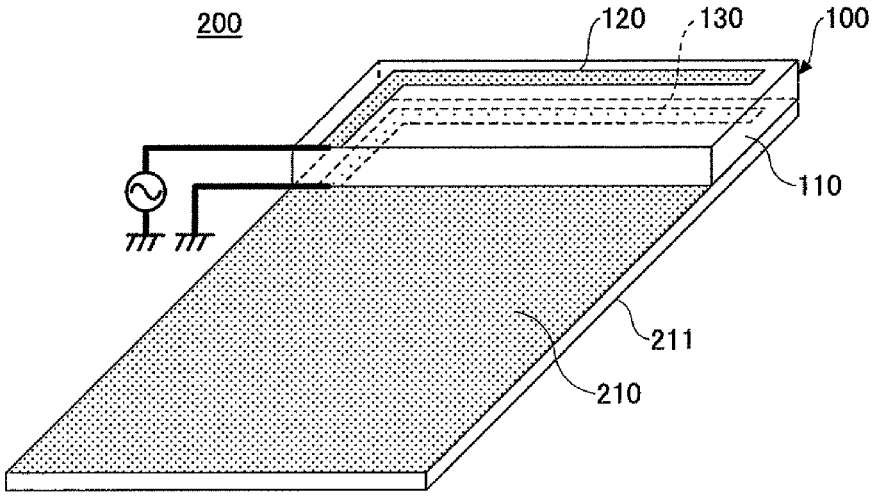
FIG. 2 illustrates the structure of the circuit board of the first embodiment.

Within the first embodiment, the printed-wiring board 110 is made of a glass epoxy resin having a thickness of about 0.8 mm. For example, the printed wiring board 110 includes a FR4 substrate whose relative permittivity $\in_r$ is about 4.7. Referring to FIG. 2, the antenna element 120 and the ground element 130 are shaped like a alphabetical letter of "L", which is rotated by about 90° in the clockwise direction, (hereinafter, the shape of this rotated alphabetical letter "L" may be referred to as a L shape or an inverse L shape) so as to be substantially symmetric with respect to the printed wiring board 110. An antenna element and a ground element in the inverse L shape may be referred to as an inverse L type antenna element and an inverse L type ground element, respectively. Specifically, patterns of the antenna element 120 and the ground element 130 may be formed in a manner similar to a case where a wiring pattern made of copper is formed. Meanwhile, the first embodiment explains a case where the printed-wiring board 110 is used. However, a board made of another dielectric material such as a ceramics board formed by AlN, $Al_2O_3$ or the like and a plastic board may be used.

Referring to FIG. 2, the circuit board 200 includes an antenna device 100 of the first embodiment. Specifically, a ground (GND) area 210 is formed on a surface of a printed-wiring board 211 forming the circuit board 200. The ground area 210 is grounded. The ground area 210 is connected to the ground element 130 of the antenna device 100. Within the first embodiment, the circuit board 200 has the antenna device 100.

Figure 3:
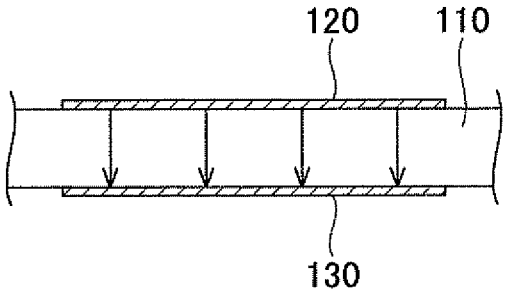
FIG. 3 schematically illustrates a part of the antenna device of the first embodiment.

Next, a positional relationship between the antenna element 120 and the ground element 130 in the antenna device 100 of the first embodiment is described. FIG. 3 illustrates a part of a cross-section perpendicularly cut along a dot chain line 1A-1B in FIG. 1. Referring to FIG. 3, the antenna element 120 and the ground element 130 are formed on both surfaces of the printed-wiring board 110 so as to be symmetric with respect to the printed-wiring board 110. In this case, by applying a high-frequency voltage to the antenna element 120, an electric field occurs between the antenna element 120 and the ground element 130 in a direction indicated by arrows in FIG. 3. Said differently, the electric field is generated in a thickness direction of the printed-wiring board 110.

(Memory Card)

Next, a memory card of the first embodiment is described. A secure Digital (SD) card is exemplified as the memory card of the first embodiment. However, the first embodiment is applicable to another standard of memory cards and another type of memory cards.

Figure 4:
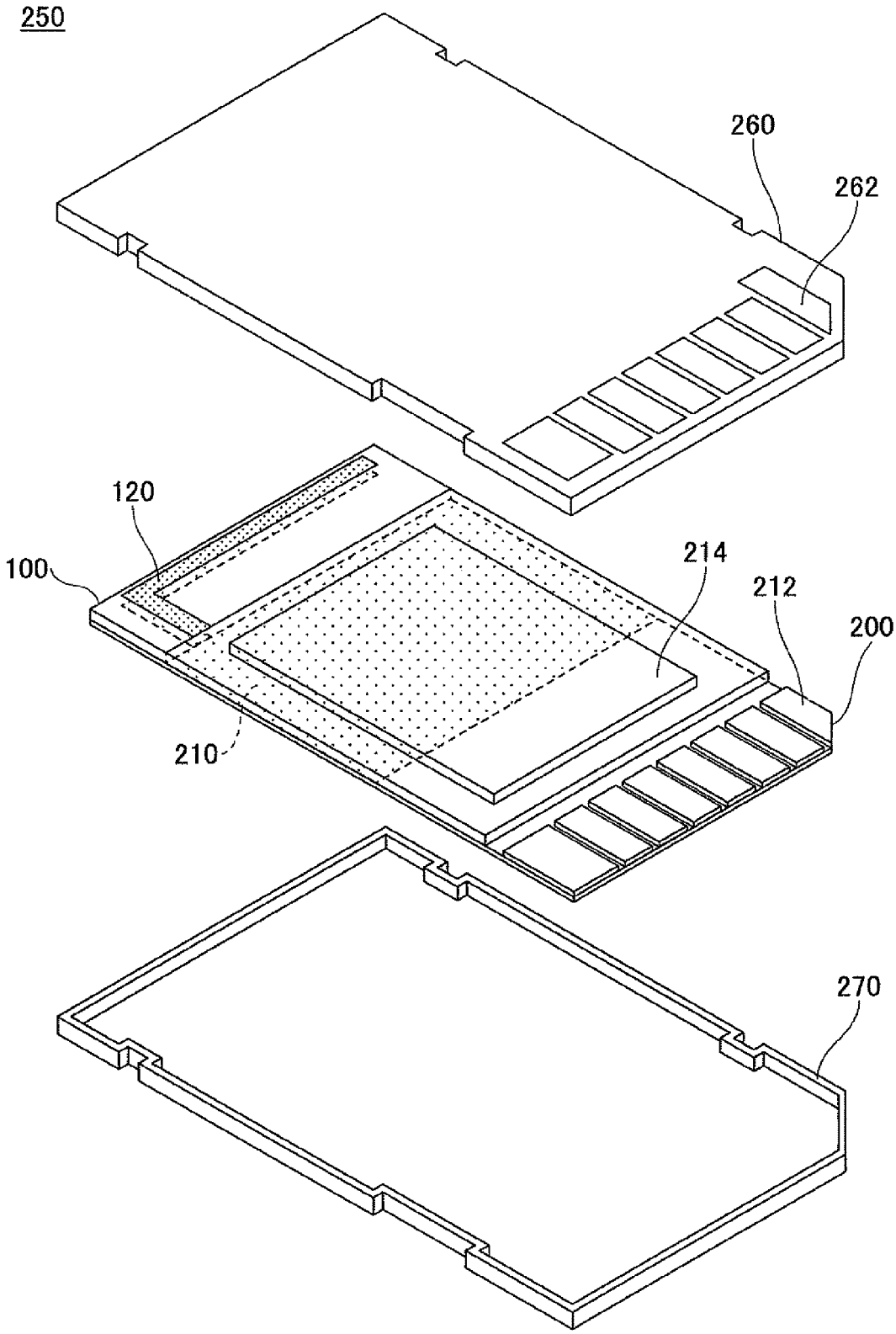
FIG. 4 illustrates the structure of the memory card of the first embodiment.

Referring to FIG. 4, the memory card 250 of the first embodiment includes a circuit board 200 on which an antenna device 100 is mounted, a first case 260 made of a resin material such as a plastic, and a second case 270. The circuit board 200 is accommodated in a space covered by a first case 260 and a second case 270. The circuit board 200 has an external connection terminal 212 to be connected to a memory card socket provided inside an electronic apparatus such as a digital camera. Further, an electronic part 214 having a memory, an electronic circuit or the like is installed in the circuit board 200. An opening portion 262 is formed in the first case 260 so as to expose the external connection terminal 212 to an outside. The memory card 250 is formed by joining the first case 260 to the second case 270 so as to cover the circuit board 200.

The antenna device 100 of the memory card 250 of the first embodiment is provided in an end portion of the circuit board 200 opposite to another end portion where the external connection terminal 212 is provided. Since the external connection terminal 212 is connected to the memory card socket, the external connection terminal 212 can intrude into an inside of the digital camera or the like. Therefore, the antenna device 100 is formed at a position in a vicinity of a loading slot for the memory card 250.

Figure 5:
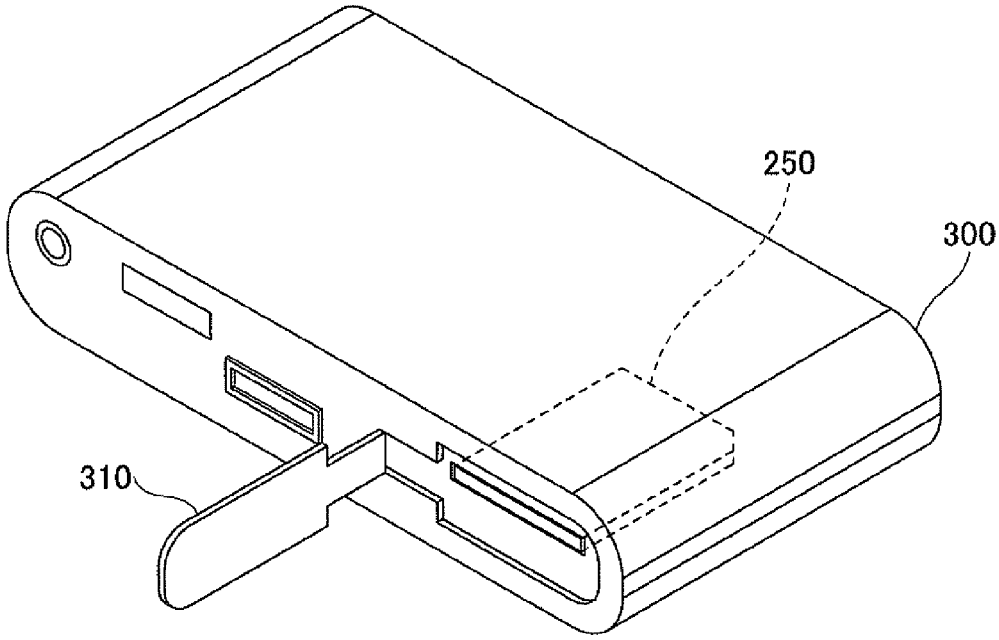
FIG. 5 is a perspective view of a digital camera for illustrating a part of receiving the memory card.

Referring to FIG. 5, after the memory card 250 is loaded into the digital camera 300, the loading slot is ordinarily covered by a lid 310 or the like provided in the digital camera 300.

(Memory Card)

Figure 6:
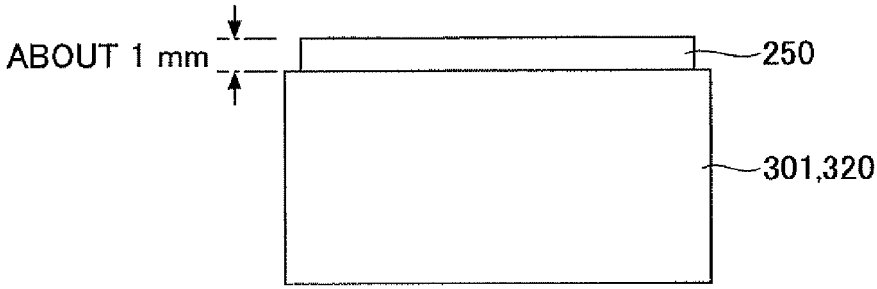
FIG. 6 illustrates a positional relationship between an inner casing and a battery inside the digital camera when the memory card is installed in the digital camera.
Figure 7:
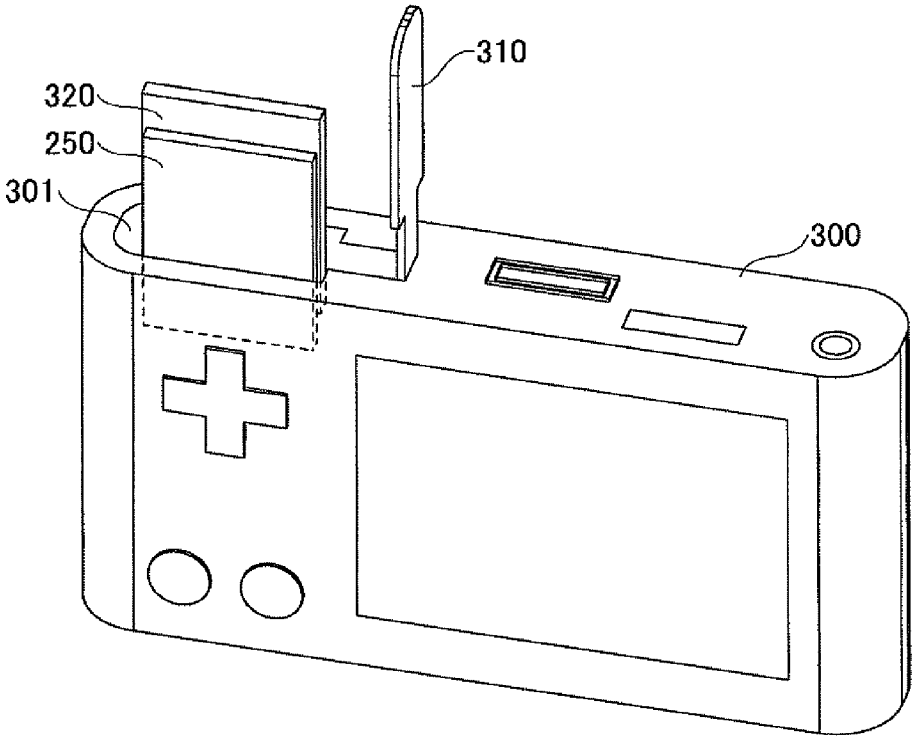
FIG. 7 illustrates a positional relationship between the memory card and the battery in the digital camera.

Meanwhile, the memory card 250 such as an SD card is loaded into the digital camera 300 when the memory card 250 is pushed in a direction toward the digital camera 300. The memory card 250 is unloaded form the digital camera 300 when the memory card 250 is pushed again in the direction toward the digital camera 300. Said differently, as illustrated in FIG. 6, the memory card 250 slightly protrudes from the digital camera 300 so that the memory card 250 can be pushed at the time of loading and unloading the memory card 250 into and from the digital camera 300. For example, a battery 320 and an inner casing 301 are provided at around the loading slot of the memory card 250. The memory card 250 may protrude by about 1 mm from the battery 320 or the inner casing 301. Within the first embodiment, as illustrated in FIG. 7, the antenna element 120 is formed in a portion of the memory card 250 protruding from the battery 320 and the inner casing 301. Especially, in an ordinary digital camera or the like, a battery 320 may be provided near the memory card 250 in consideration of a layout of the digital camera. Because the battery 320 includes a large amount of an electrically conductive material, electromagnetic waves emitted from an antenna element 120 may be easily influenced by the battery 320. Further, the inner casing 301 is thick enough to facilitate interruption of the electromagnetic waves. Within the first embodiment, the antenna element 120 is formed at a portion protruding from the battery 320 or the inner casing 301. When the memory card is loaded into the digital camera 300, the memory card 300 is connected to the digital camera 300.

(Width and Position of Antenna Element)

Figure 8:
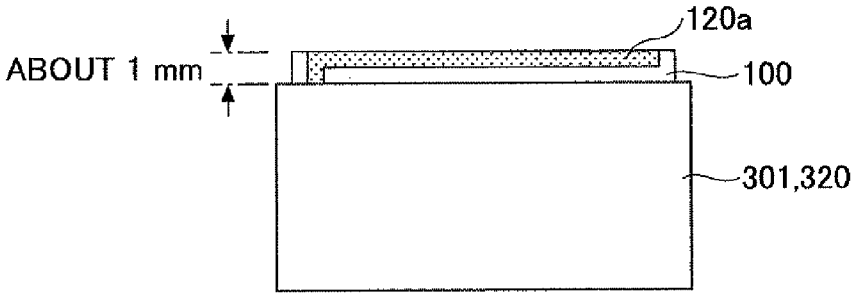
FIG. 8 schematically illustrates a linear portion of an antenna element of the first embodiment.
Figure 9:
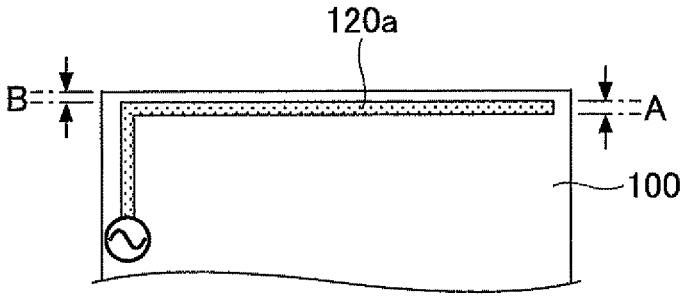
FIG. 9 schematically illustrates the position of the linear portion of the antenna element of the first embodiment.

Referring to FIG. 8 and FIG. 9, the width of the antenna element 120 and the position of the antenna element in the antenna device 100 are described in detail. As described in the above, the memory card 250 protrudes about 1 mm from the inner casing 301, the battery 320 or the like. Within the first embodiment, an antenna element linear portion 120*a* of the antenna element 120 included in the antenna device 100 is formed outside of the inner casing 301, a battery 320 or the like. At this time, a width A of the antenna element linear portion 120*a* (the width A being a width of an end of the antenna element linear portion 120*a* in a direction substantially perpendicular to a longitudinal direction of the antenna element linear portion 120*a*) becomes greater than or equal to 0.05 mm and smaller than 1 mm. The memory card 250 protrudes about 1 mm from the inner casing 301, the battery 320, or the like. Therefore, if the width A of the antenna element linear portion 120*a* exceeds 1 mm, the antenna element 120 intrudes into the inside of the inner casing, the battery 320 or the like. In order to position the antenna element linear portion 120*a* outside the inner casing 301, the battery 320 or the like, the width A of the antenna element linear portion 120*a* is smaller than 1 mm. When the width A of the antenna element linear portion 120*a* is excessively small, there is a probability that the characteristics of the antenna become less preferable. However, if the width A of the antenna element linear portion 120*a* is greater than or equal to 0.05 mm, this probability may not exist.

Figure 10:
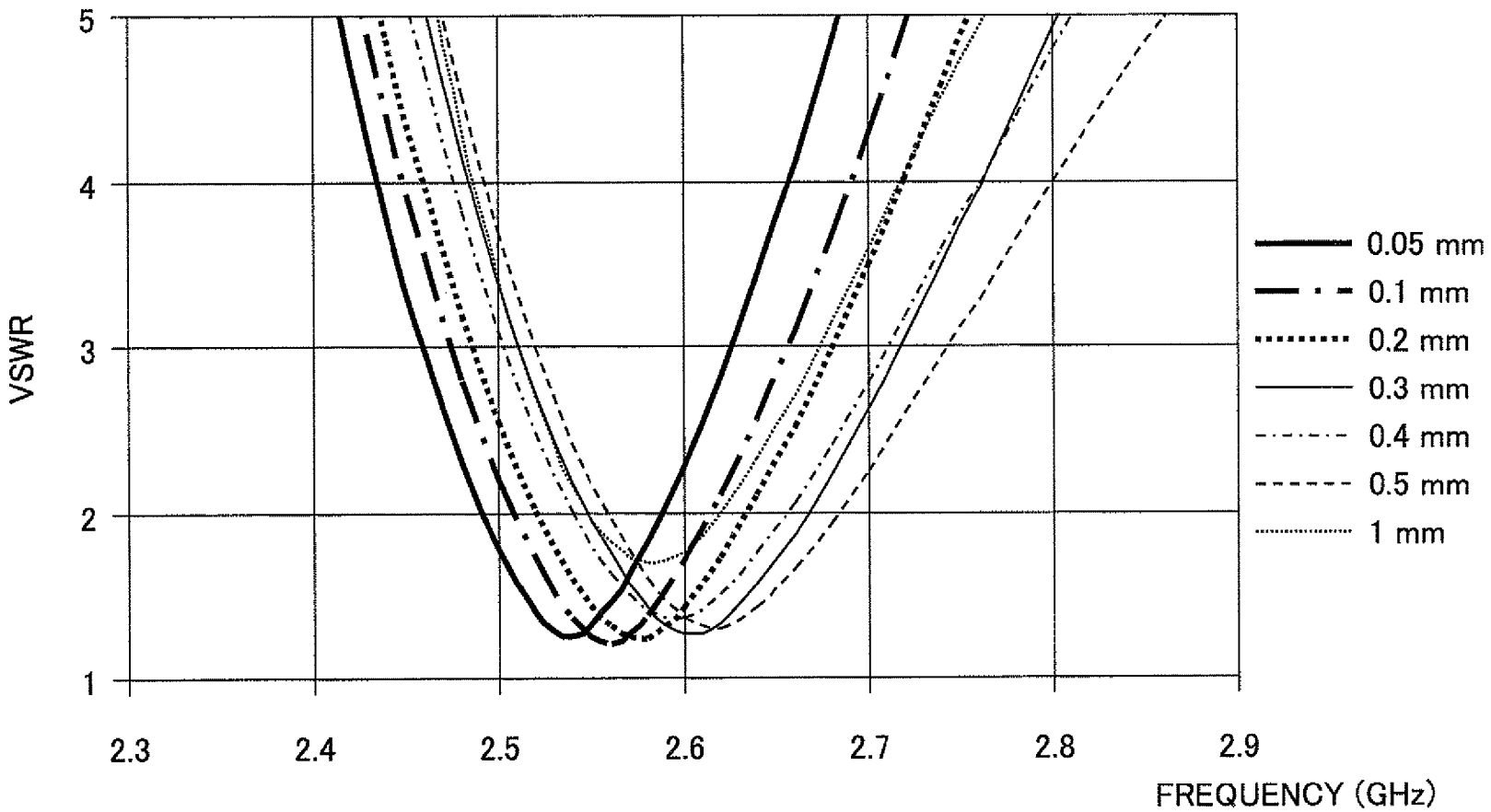
FIG. 10 illustrates VSWR characteristics at a time of changing the width of the linear portion of the antenna.

FIG. 10 illustrates a simulation result of Voltage Standing Wave Ratio (VSWR) characteristics in a case where the width A of the antenna element linear portion 120*a* is changed. Referring to FIG. 10, when the width A of the antenna element linear portion 120*a* is smaller than 1 mm, the VSWR characteristics scarcely change. If the width A of the antenna element linear portion 120*a* is smaller than 0.5 mm, the VSWR characteristics are further improved. The reflection becomes smaller as the value of the VSWR becomes smaller.

Further, a distance B between the edge of the antenna device 100 and a side (the side being closer to the edge of the antenna device 100) of the antenna element linear portion 120*a* in a direction substantially perpendicular to the longitudinal direction of the antenna element linear portion 120*a* is preferably formed so that the sum of the width A and the distance B becomes smaller than or equal to 1 mm. Further, it is preferable that the distance B is formed smaller than or equal to 0.5 mm. The antenna element linear portion 120*a* is made of a metallic material such as copper having a thickness of 0.035 mm to 0.04 mm.

Figure 11:
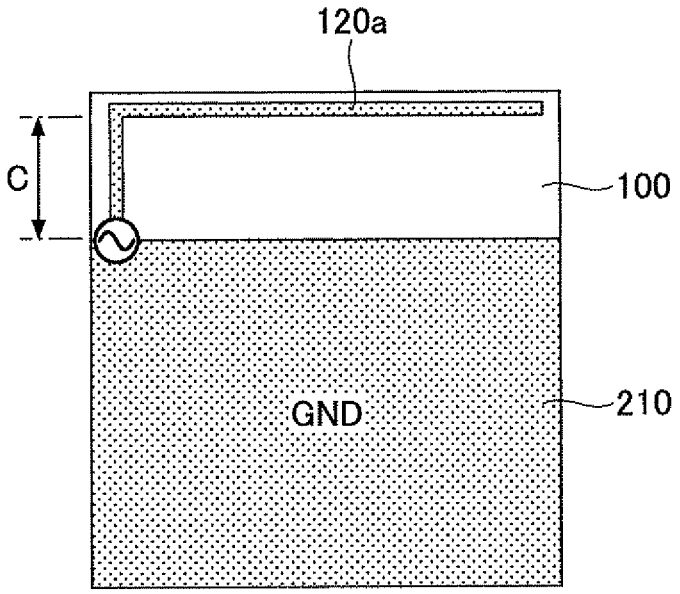
FIG. 11 schematically illustrates the position of the linear portion of the antenna element of the first embodiment.

Referring to FIG. 11, a gap C between the antenna element linear portion 120*a* and the ground area 210 in the antenna device 100 of the first embodiment is greater than or equal to 0.05 λm, where λ designates the wavelength used by the antenna. The gap C can be measured in a direction substantially perpendicular to the antenna element linear portion 120*a* and exists between a side (the side being closer to the ground area 210, being a rectangular portion in, for example, FIG. 11) of the antenna element linear portion 120*a* and a side (the side being closer to the antenna element linear portion 120*a*) of the ground area 210. Said differently, the gap C is an internal gap between the antenna element linear portion 120*a* and the ground area 210. Since the electromagnetic waves having a frequency of 2.4 GHz to 2.5 GHz are used by the antenna device 100 of the first embodiment, the gap C is about 5 mm or smaller. It is not preferable for the characteristics of the circuit board 200 to make the gap C between the antenna element linear portion 120*a* and the ground area excessively small. Even if the ground area 210 is surrounded by the inner casing 301, the battery 320 or the like, the characteristics of the circuit board 200 is not degraded. In consideration of characteristics of the antenna element linear portion 120*a* and ease in manufacturing the antenna element linear portion 120*a*, the antenna element linear portion 120*a* is preferably formed outside the inner casing 301, the battery 320 or the like, and the ground area 210 is preferably formed inside the inner casing 310, the battery 320 or the like.

(Characteristics of Antenna Device)

The VSWR characteristics of the antenna device 100 and the memory card 250 of the first embodiment are described next. It is preferable that a frequency, at which the value of VSWR is lowered, does not change depending on types of the digital cameras.

Figure 12:
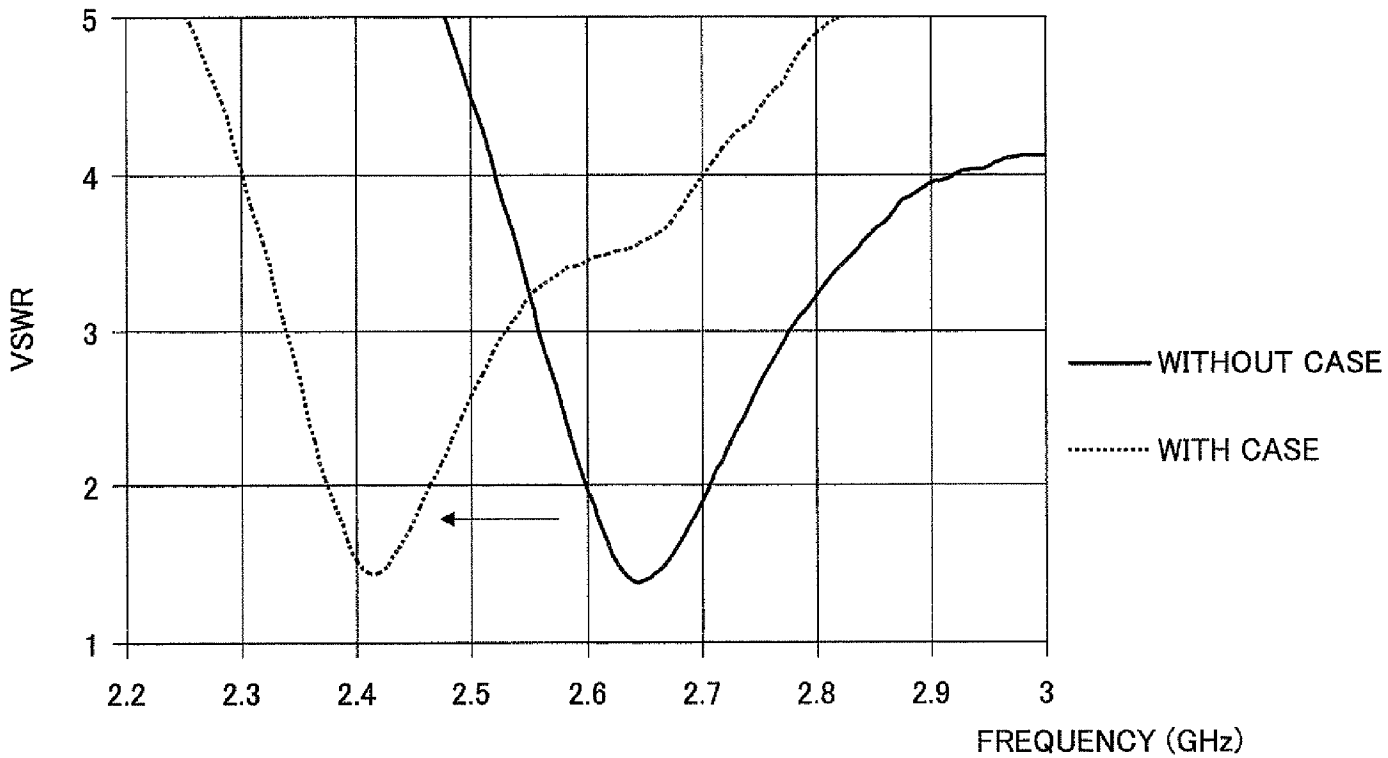
FIG. 12 illustrates VSWR characteristics of the antenna device and the memory card of the first embodiment.

Referring to FIG. 12, the value of VSWR for the memory card 250 including the first and second cases 260 and 270 and the antenna device 100 covered by the first and second cases 260 and 270 (with the case) and the value of VSWR for only the antenna device 100 (without the case) are different. Specifically, the frequency, at which the value of VSWR is lowered, is shifted more on a lower frequency side in the memory card 250 with the case than the frequency, at which the value of VSWR is lowered, in only the antenna device 100 without the case. This shifting of the frequency is assumedly caused by a material of the first and the second cases 260 and 270. Therefore, when the memory card 250 is manufactured, a shift amount of the frequency toward the low frequency side is considered in manufacturing the antenna device 100.

Figure 13:
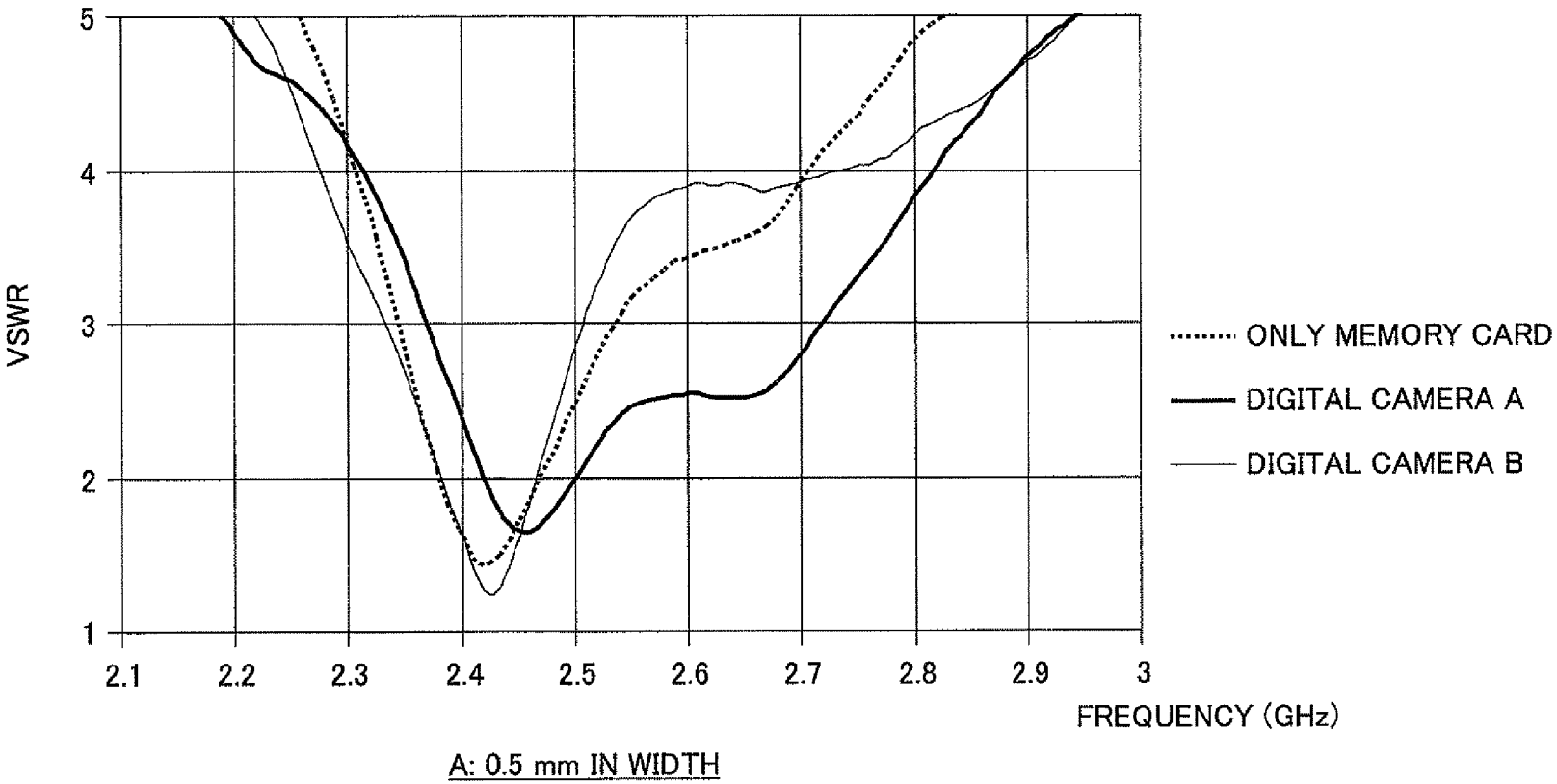
FIG. 13 illustrates VSWR characteristics of the memory card of the first embodiment.
Figure 14:
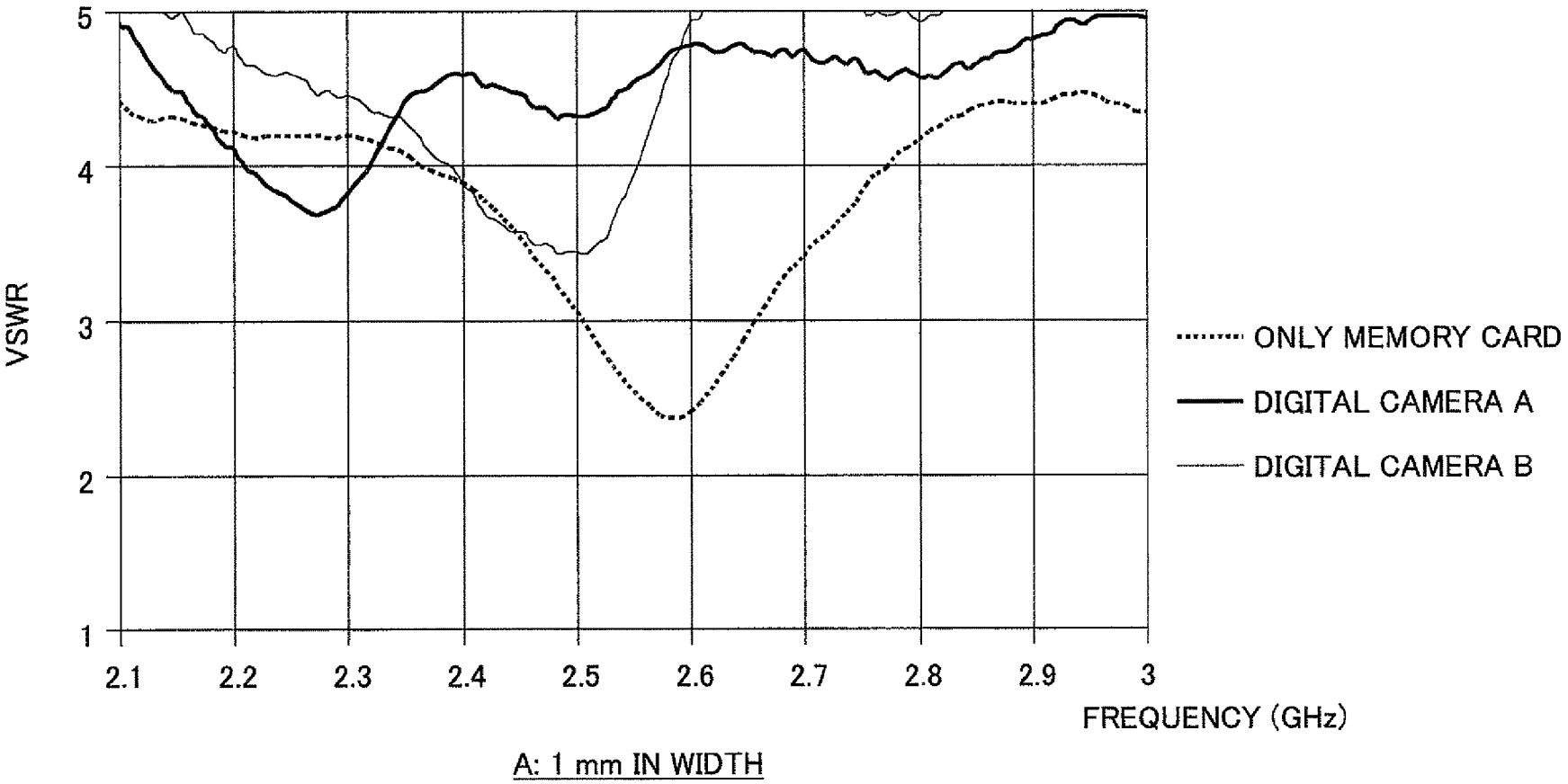
FIG. 14 illustrates VSWR characteristics of another memory card.
Figure 15:
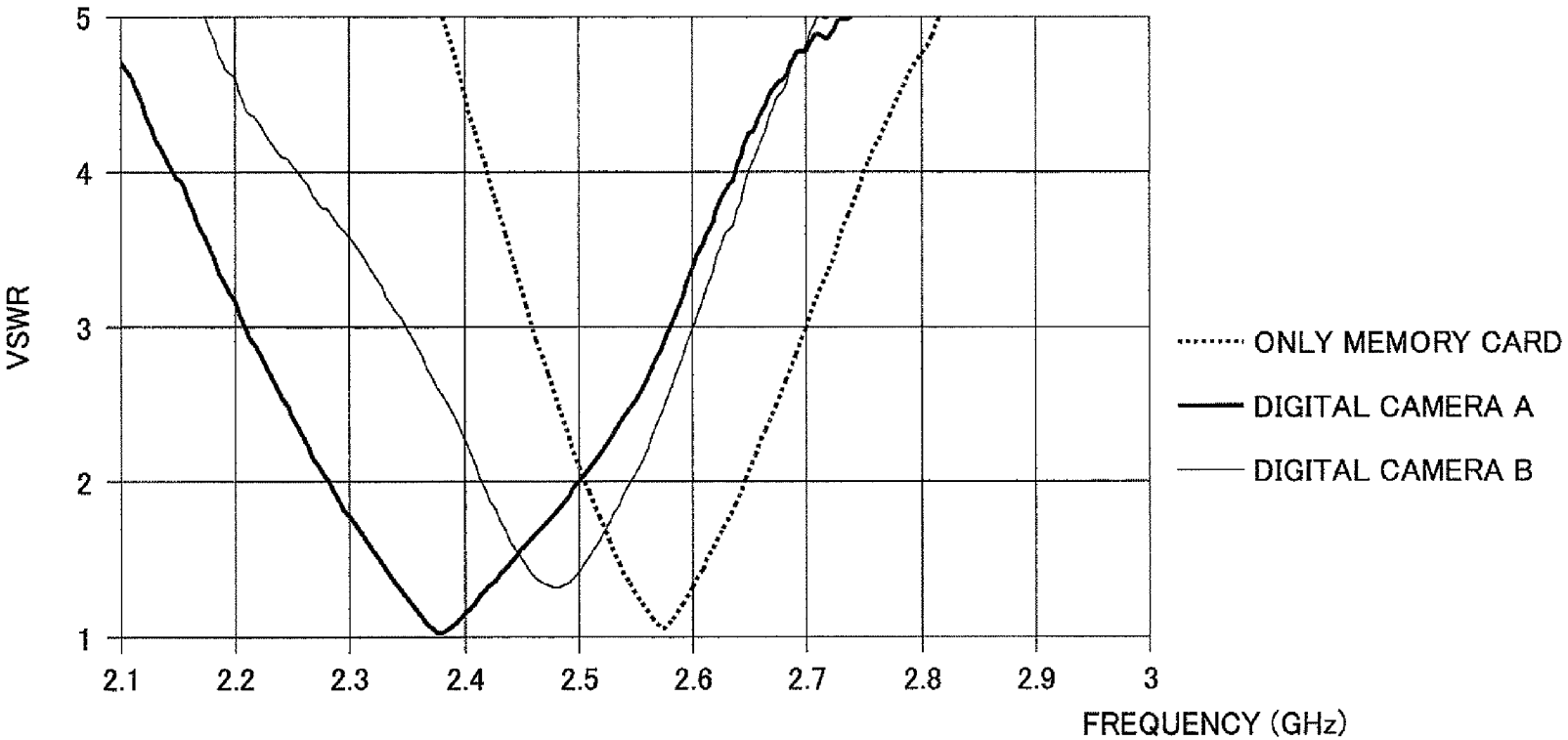
FIG. 15 illustrates VSWR characteristics of an example memory card having an antenna.

Next, the VSWR characteristics in case where only the memory card is used and in a case where the memory card is loaded into the digital camera 300 are described. FIG. 13 illustrates the VSWR characteristics related to the memory card 250 of the first embodiment having a width A of the antenna element linear portion 120*a* of 0.5 mm. Three VSWR characteristics curves corresponding to cases where the memory card 250 is not loaded into a digital camera (only the memory card 250), the memory card 250 is loaded into a digital camera A, and the memory card 250 is loaded into a digital camera B are drawn in FIG. 13. FIG. 14 illustrates the VSWR characteristics related to the memory card 250 of the first embodiment having a width A of the antenna element linear portion 120*a* of 1 mm. Three VSWR characteristics curves corresponding to cases where the memory card 250 is not loaded into a digital camera (only the memory card 250), the memory card 250 is loaded into a digital camera A, and the memory card 250 is loaded into a digital camera B are drawn in FIG. 14. FIG. 15 illustrates the VSWR characteristics related to an exemplary memory card. Three VSWR characteristics curves corresponding to cases where the exemplary memory card is not loaded into a digital camera (only the memory card), the exemplary memory card is loaded into a digital camera A, and the exemplary memory card is loaded into a digital camera B are drawn in FIG. 15.

Referring to FIG. 14 and FIG. 15, among the cases where a memory card is not loaded and where the memory cards are loaded in the digital cameras A and B, the frequencies at which the values of VSWR are lowered are substantially different. However, Referring to FIG. 13, among the cases where a memory card is not loaded and where the memory cards are loaded in the digital cameras A and B, the frequencies at which the values of VSWR are lowered are substantially the same.

(Manufacturing Method of Antenna Device and Circuit Board)

Next, a manufacturing method of the antenna device and the circuit board of the first embodiment is described.

Figure 16:
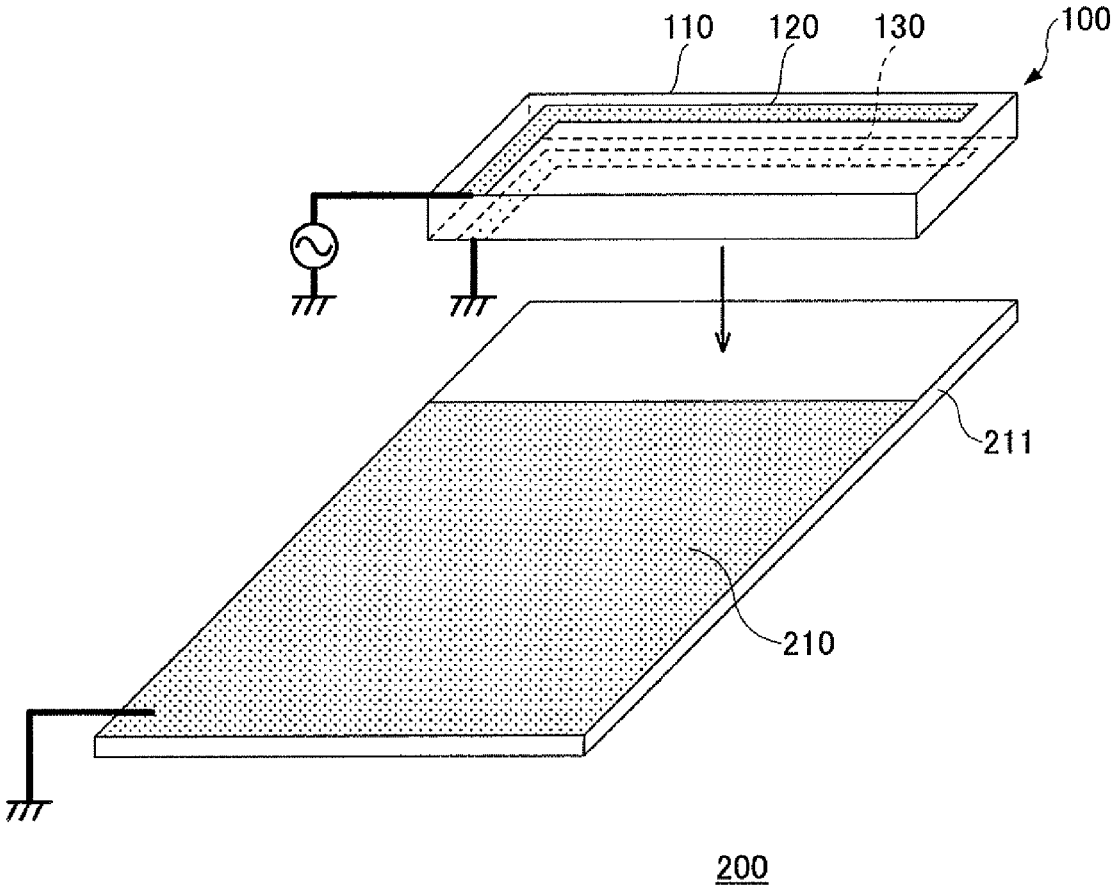
FIG. 16 illustrates a manufacturing method of the circuit board of the first embodiment.

Referring to FIG. 16, the circuit board 200 of the first embodiment may be formed by adhering the antenna device 100 including the printed-wiring board 110, on both surfaces of which the antenna element 120 and the ground element 130 are formed, to a predetermined position of the printed-wiring board 211, on which a ground area 210 is formed, and further by connecting the ground element 130 to the ground area 210.

Figure 17:
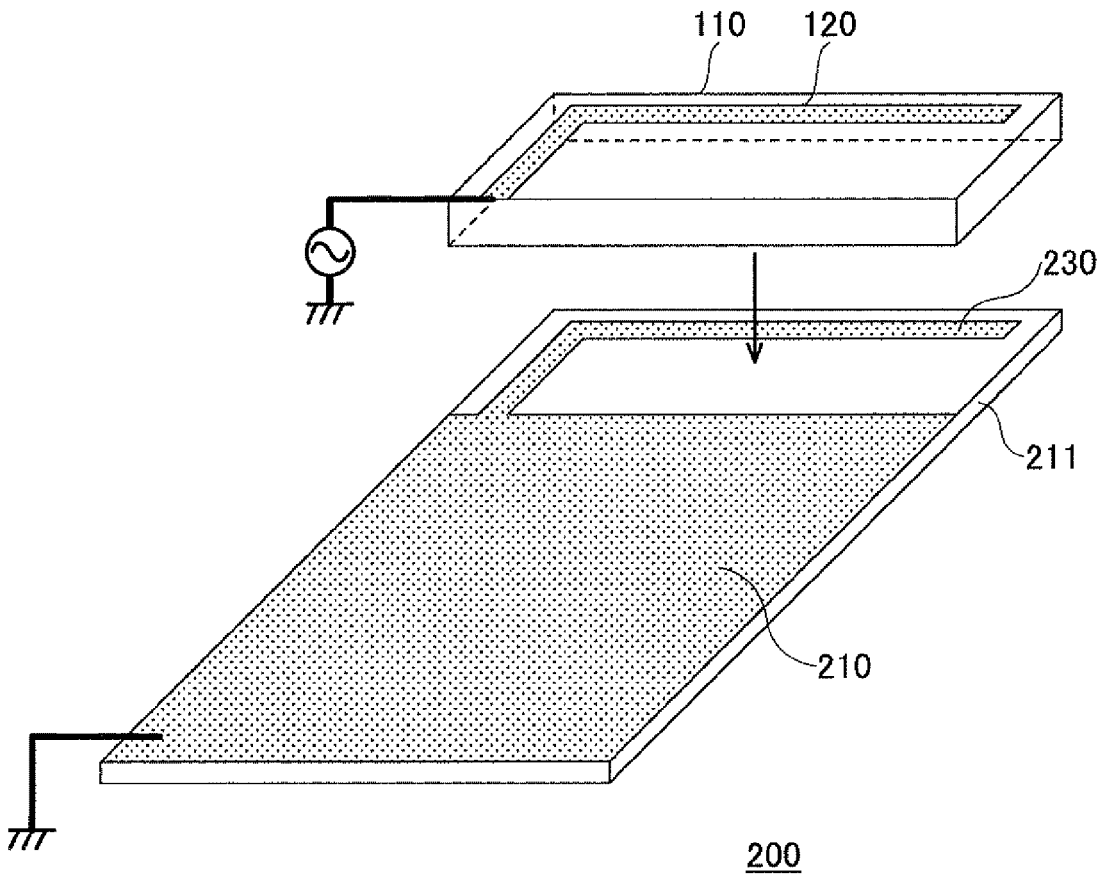
FIG. 17 illustrates another manufacturing method of the circuit board of the first embodiment.

Further, referring to FIG. 17, the circuit board 200 of the first embodiment may be formed by adhering a printed-wiring board 110 having the antenna element 120 on one surface of the printed-wiring board 110 to a printed-wiring board 211 having a ground area 210 and a ground element 230 connected to the ground area 210 so that the other surface of the printed-wiring board 110 faces the ground element 230 of the printed-wiring board 211.

Figure 18:
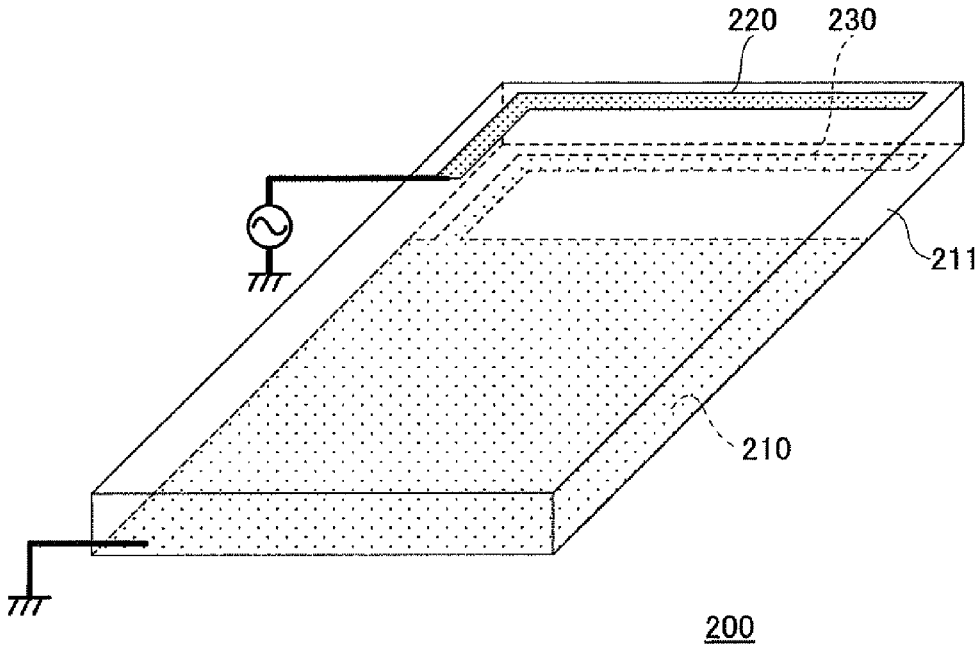
FIG. 18 illustrates another manufacturing method of the circuit board of the first embodiment.
Figure 19:
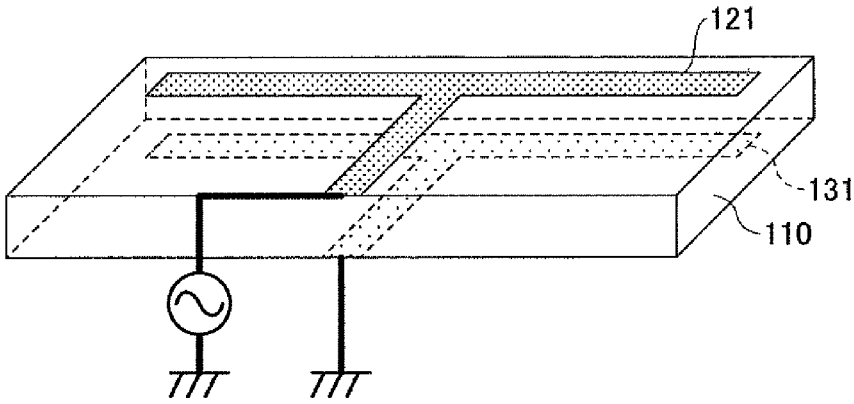
FIG. 19 schematically illustrates a part of another antenna device of the first embodiment.

Referring to FIG. 18, the circuit board 200 of the first embodiment may be configured to have an antenna element 220 on one surface of the printed wiring board 211, and a ground element 230 and a ground area 210 connected to the ground element 230 on the other surface of the printed wiring board 211. With this structure, the number of the printed-wiring board 211 becomes one, thereby enabling obtaining the circuit board 200 having the antenna device at a lower cost.

Functionally, the antenna element 220 corresponds to the antenna element 120, and the ground element 230 corresponds to the ground element 130.

The shape of the antenna device 100 is not limited to the inverse L shape and may be a T shape. Specifically, referring to FIG. 19, an antenna element 121 in a T-like shape is formed on one surface of a printed-wiring board 110 and a ground element 131 in a T-like shape may be formed on the other surface of the printed wiring board 110.

In the first embodiment, an electronic circuit or the like may be formed on the printed-wiring board 211. However, the electronic circuit or the like is omitted in the above figures. Specifically, an electronic circuit or the like may be formed in an area where there isn't the ground area 210 or where the printed-wiring board 211 has a multilayer structure and an electronic circuit or the like is formed inside the multilayer structure.

Second Embodiment

Next, the second embodiment is described. An antenna device 100 of the second embodiment is formed so that a predetermined frequency range can be used by increasing an inductance without widening an area where an antenna element or the like is formed and by lowering the frequency range.

Figure 20:
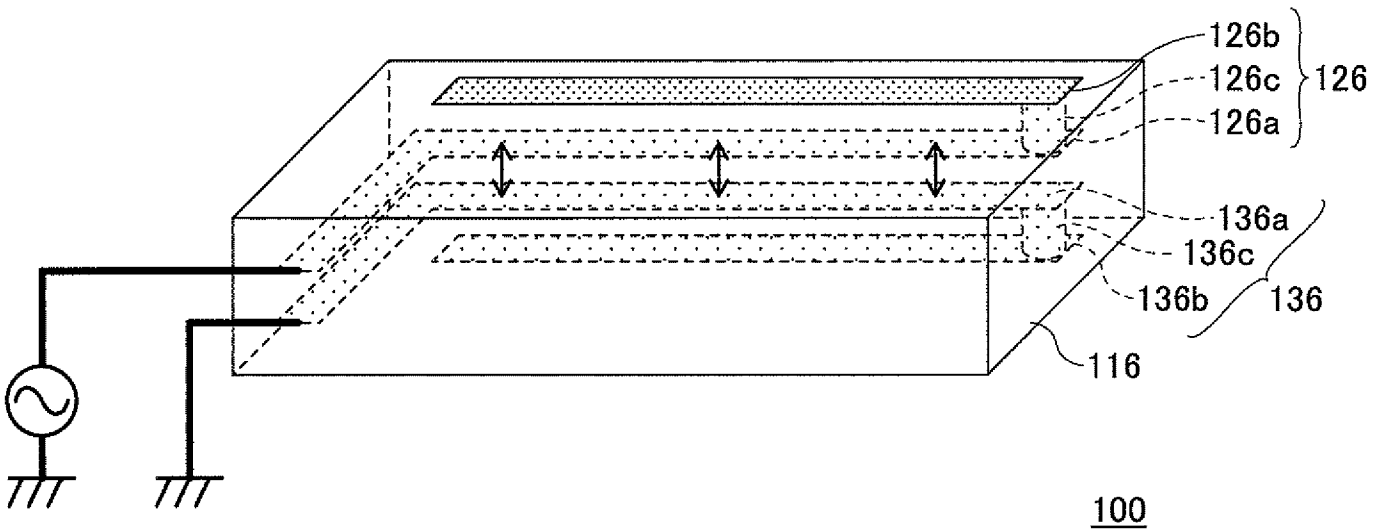
FIG. 20 illustrates a structure of an antenna device of a second embodiment.

The structure of the antenna device 100 of the second embodiment is illustrated in FIG. 20. In the antenna device 100, a multilayer printed-wiring board 116 is used, and an antenna element 126 and a ground element 136 are multilayered. The antenna element 126 includes a first antenna element 126*a* formed inside the printed-wiring board 116 and a second antenna element 126*b* formed on one surface of the printed-wiring board 116. The first antenna element 126*a* and the second antenna element 126*b* are connected by an antenna element connecting portion 126*c* formed inside a throughhole for connecting the first antenna element 126*a* and the second antenna element 126*b*.

The ground element 136 includes a first ground element 136*a* formed inside the printed-wiring board 116 and a second ground element 136*b* formed on the other surface of the printed-wiring board 116. The first ground element 136*a* and the second ground element 136*b* are connected by a ground element connecting portion 136*c* formed inside a throughhole for connecting the first ground element 136*a* and the second ground element 136*b*.

Within the second embodiment, without expanding an area inside the printed-wiring board 116 where the antenna element 126 or the ground element 136 are formed, the inductance of the antenna element 126 or the inductance of the ground element 136 can be increased.

Figure 21:
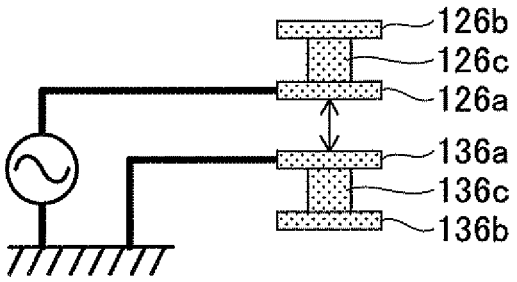
FIG. 21 schematically illustrates a part of the antenna device of the second embodiment.

Referring to FIG. 21, a cross-sectional view of an arrangement of the antenna element 126 and the ground element 136 of the antenna device 100 illustrated in FIG. 20 is schematically illustrated. The first antenna element 126*a*, the second antenna element 126*b*, the first ground element 136*a* and the second ground element 136*b* are formed so that areas of these overlap in the thickness direction of the antenna device 100. Specifically, the areas of the antenna element 126*a* and the first ground element 136*a* may entirely overlap in the thickness direction of the antenna device 100, and the areas of the second antenna element 126*b* and the second ground element 136*b* may entirely overlap in the thickness direction of the antenna device 100. Thus, when a high frequency electric signal is applied to the antenna element 126, the antenna element 126 can be unidirectionally excited in the thickness direction of the printed-wiring board 116.

Figure 22:
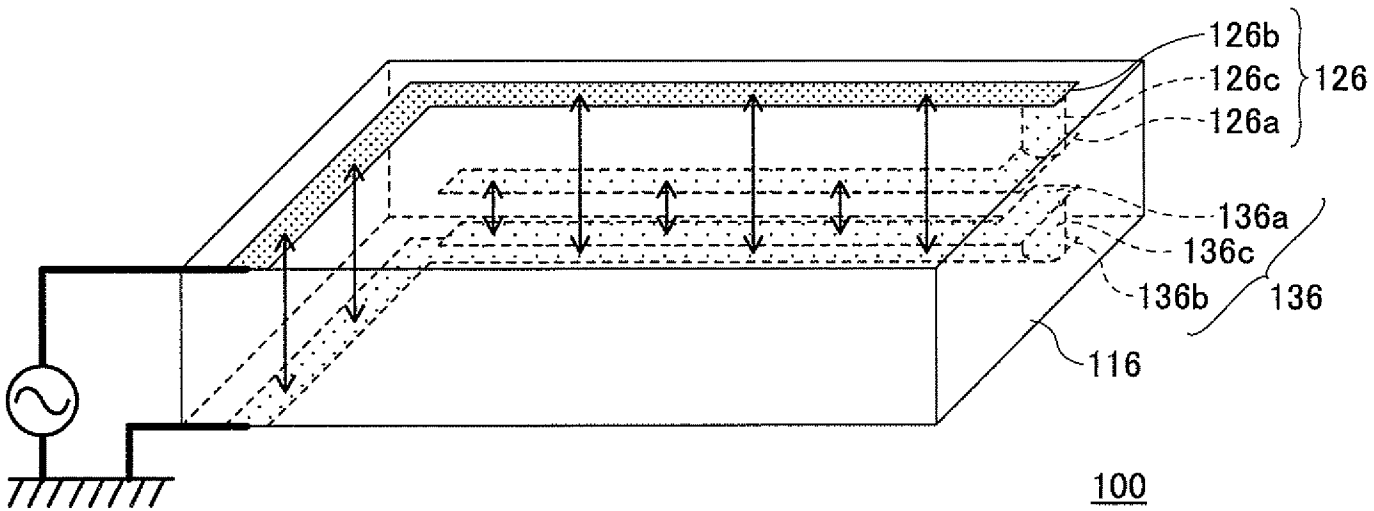
FIG. 22 schematically illustrates a part of another antenna device of the second embodiment.
Figure 23:
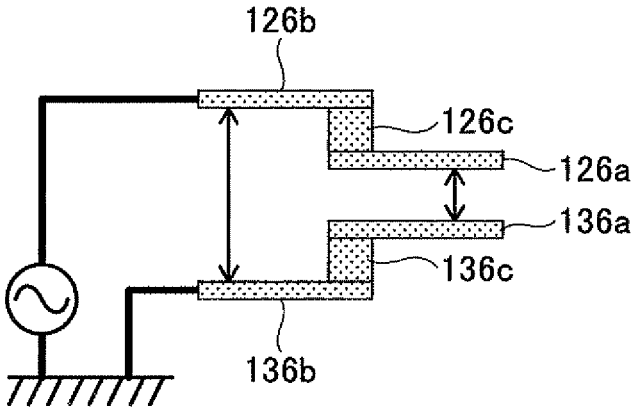
FIG. 23 schematically illustrates a part of another antenna device of the second embodiment.

Referring to FIG. 22, positions of a first antenna element 126*a* and a second antenna element 126*b* may not overlap, and positions of a first ground element 136*a* and a second ground element 136*b* may not overlap, thereby forming shifted areas of the first antenna element 126*a*, the second antenna element 126*b*, the first ground element 136*a* and the second ground element 136*b*. In this case, an electromagnetic field may leak from the shifted areas. Referring to FIG. 23, a cross-sectional view of an arrangement of the antenna element 126 and the ground element 136 of the antenna device illustrated in FIG. 22 is schematically illustrated.

The other portions are the same as those described in the first embodiment.

Within the embodiments, in the memory card, a shape of the antenna element and a shape of the ground element may be substantially symmetrical with respect to the circuit board and the board.

Further, a shape of the antenna element and a shape of the ground element may be substantially symmetrical with respect to the circuit board and the board.

Further, the circuit board may be a printed-wiring board, and the board is another printed-wiring board.

Further, the circuit board may be a printed-wiring board, and the board is another printed-wiring board.

Further, an electronic part may be mounted on the circuit board.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of superiority or inferiority of the invention. Although the embodiments of the present invention have been described in detail, it should be understood that the various changes, substitutions, and alterations could be made hereto without departing from the spirit and scope of the invention.

What is claimed is:

1. A memory card having a built-in antenna, the memory card connectable to an electronic apparatus, the memory card comprising:

a circuit board configured to be covered by a case;

an antenna element formed on one surface of the circuit board or on one surface of a board mounted on the circuit board; and a ground element formed on another surface of the circuit board or on another surface of the board mounted on the circuit board, wherein a part or all of the antenna element and a part or all of the ground element are formed to protrude outside the electronic apparatus when the memory card is connected to the electronic apparatus.

2. The memory card according to claim 1, wherein the antenna element is formed to be in a L shape and has an antenna element linear portion as a part of the L shape, the ground element is formed to be in a L shape, and the antenna element linear portion protrudes outside the electronic apparatus when the memory card is connected to the electronic apparatus.

3. The memory card according to claim 1, wherein the circuit board includes the ground element, the ground element includes a ground area, and a gap between the antenna element and the ground area is smaller than or equal to 0.05λ, where λ designates a wavelength used by the built-in antenna.

4. The memory card according to claim 1, wherein a shape of the antenna element and a shape of the ground element are substantially symmetrical with respect to the circuit board and the board.

5. The memory card according to claim 1, wherein the circuit board is a printed-wiring board, and the board is another printed-wiring board.

6. The memory card according to claim 5, wherein the printed-wiring board has plural layers, the antenna element is formed on two or more layers of the plural layers and the ground element is formed on two or more layers of the layers on which the antenna element is not formed among the plural layers.

7. The memory card according to claim 1, wherein the built-in antenna is used for a frequency band between 2.4 GHz to 2.5 GHz.

8. The memory card according to claim 1, wherein the built-in antenna is used for communications for a wireless LAN or Bluetooth ("Bluetooth" is a registered trademark).

9. A memory card having a built-in antenna, the memory card connectable to an electronic apparatus, the memory card comprising:

a circuit board configured to be covered by a case;

an antenna element formed on one surface of the circuit board or on one surface of a board mounted on the circuit board; and a ground element formed on another surface of the circuit board or on another surface of the board mounted on the circuit board, wherein a width of the antenna element is smaller than 1 mm, and a width of the ground element is smaller than 1 mm.

10. The memory card according to claim 9, wherein the antenna element is formed to be in a L shape, and the ground element is formed to be in a L shape.

11. The memory card according to claim 9, wherein the circuit board includes the ground element, the ground element includes a ground area, and a gap between the antenna element and the ground area is smaller than or equal to 0.05λ, where λ designates a wavelength used by the built-in antenna.

12. The memory card according to claim 9, wherein a distance from an edge of the circuit board on a side, which is opposite to a connection side of the memory card connected with electronic apparatus, to the antenna element and the ground element is smaller than or equal to 0.5 mm.

13. The memory card according to claim 9, wherein a distance from an edge of the circuit board on a side, which is opposite to a connection side of the memory card connected with electronic apparatus, to the antenna element and the ground element is smaller than or equal to 0.5 mm and/or the width of the antenna element is smaller than or equal to 0.5 mm.

14. The memory card according to claim 9, wherein a sum of the width of the antenna element and a distance from an edge of the circuit board on a side, which is opposite to a connection side of the memory card connected with electronic apparatus, to the antenna element and the ground element is smaller than or equal to 1.0 mm.

15. A memory card having a built-in antenna, the memory card connectable to an electronic apparatus, the memory card comprising:

a circuit board configured to be covered by a case;

an antenna element formed to be in a L shape on one surface of the circuit board or on one surface of a board mounted on the circuit board;

a ground element formed to be in a L shape on another surface of the circuit board or on another surface of the board mounted on the circuit board; and a ground area provided on the circuit board, wherein a gap between the antenna element and the ground area is smaller than or equal to 0.05λ where λ designates a wavelength used by the built-in antenna.

16. The memory card according to claim 15, wherein a distance from an edge of the circuit board on a side, which is opposite to a connection side of the memory card connected with electronic apparatus, to the antenna element and the ground element is smaller than or equal to 0.5 mm.

* * * * *